US009010028B2

(12) United States Patent
Hutchings, Jr.

(10) Patent No.: US 9,010,028 B2
(45) Date of Patent: Apr. 21, 2015

(54) RETRACTABLE GUTTER

(76) Inventor: Robert K. Hutchings, Jr., Glenburn, ME (US)

( * ) Notice: Subject to any disclaimer, the term of this patent is extended or adjusted under 35 U.S.C. 154(b) by 0 days.

(21) Appl. No.: 13/417,854

(22) Filed: Mar. 12, 2012

(65) Prior Publication Data

US 2012/0240480 A1 Sep. 27, 2012

Related U.S. Application Data

(60) Provisional application No. 61/467,597, filed on Mar. 25, 2011.

(51) Int. Cl.

| | |
|---|---|
| ***E04D 13/072*** | (2006.01) |
| ***E04D 13/064*** | (2006.01) |
| ***E04D 13/076*** | (2006.01) |
| ***E04D 13/08*** | (2006.01) |

(52) U.S. Cl.

CPC ..... *E04D 13/064* (2013.01); *E04D 13/0727* (2013.01); *E04D 13/0645* (2013.01); *E04D 13/076* (2013.01); *E04D 13/0762* (2013.01); *E04D 13/08* (2013.01)

(58) Field of Classification Search

CPC ..... E04D 13/064; E04D 13/076; E04D 13/08; E04D 13/068; E04D 13/0685; E04D 13/0727

USPC ..... 52/11, 12, 16; 248/48.1, 48.2

See application file for complete search history.

(56) References Cited

U.S. PATENT DOCUMENTS

| | | | | |
|---|---|---|---|---|
| 538,108 A | | 4/1895 | Freeze | |
| 2,625,353 A | * | 1/1953 | Henry | 248/48.2 |
| 3,091,055 A | * | 5/1963 | Hegedusich | 52/16 |
| 4,072,285 A | | 2/1978 | Greenwood | |
| 4,185,420 A | | 1/1980 | Medland | |
| 4,446,658 A | * | 5/1984 | Gouin | 52/11 |
| 4,669,232 A | * | 6/1987 | Wyatt | 52/11 |
| 4,813,190 A | * | 3/1989 | Wittig | 52/11 |
| 5,274,965 A | * | 1/1994 | Jackson | 52/11 |
| 5,317,843 A | * | 6/1994 | Sheehan | 52/11 |
| 5,526,611 A | * | 6/1996 | Leahy | 52/11 |
| 5,893,239 A | * | 4/1999 | Leahy | 52/11 |
| 5,896,706 A | * | 4/1999 | Pike | 52/11 |
| 6,219,972 B1 | * | 4/2001 | Zusy | 52/12 |
| 6,233,876 B1 | * | 5/2001 | Obidniak | 52/16 |
| 6,854,692 B1 | * | 2/2005 | Winkel | 248/48.1 |
| 7,111,814 B1 | * | 9/2006 | Newman | 248/274.1 |
| 7,357,360 B2 | * | 4/2008 | Staggs | 248/48.1 |
| 7,418,801 B2 | * | 9/2008 | Loveless | 52/11 |

FOREIGN PATENT DOCUMENTS

| | | | | |
|---|---|---|---|---|
| JP | 03169955 A | * | 7/1991 | E04D 13/06 |
| JP | 03169956 A | * | 7/1991 | E04D 13/06 |
| JP | 03260255 A | * | 11/1991 | E04D 13/06 |
| JP | 05187103 A | * | 7/1993 | E04D 13/06 |

* cited by examiner

*Primary Examiner* — Brian Glessner
*Assistant Examiner* — Jessie Fonseca
(74) *Attorney, Agent, or Firm* — Patricia M. Mathers

(57) ABSTRACT

The invention is a retractable gutter system that allows the gutter to be moved under the eaves in climates that are typically below freezing, to prevent an ice dam from forming under the eaves, and at times when leaf debris risks clogging the gutter. Slide retainers are affixed to the soffit and the gutter affixed to the extendible slides held in the slide retainers. The gutter is slidable between a first position in which the gutter is placed at the drip edge and a second position in which the gutter is stowed away under the eaves.

9 Claims, 6 Drawing Sheets

RETRACTABLE GUTTER

BACKGROUND INFORMATION

1. Field of the Invention

The field of the invention relates to gutters on residential and commercial buildings. More particularly, the invention relates to a retractable gutter.

2. Discussion of the Prior Art

Gutters are typically attached to the fascia under the eaves of a structure, to collect rainwater that drains from the roof. The fascia is a trim board that is fixed vertically on edge to the rafter ends or wall which conventionally carries the gutter around the eaves of the roof. In many regions that experience cold winters, snow falls on the roof of the structure and eventually melts, either due to heat loss through the roof, rain, or an ambient temperature that is above freezing. The melting snow water runs to the eaves and then into the gutter. The eave, however, is colder than the roof, so, as the water reaches the gutter, it begins to freeze. The gutter then fills up with ice and may eventually cause an ice dam to form under the eave, which may then cause water to run back up under the shingles, resulting in damage to the structure because of water leaking into the interior of the structure.

Tree debris is another source of failure of the conventional gutter system. Leaves and needles from trees often end up in gutters, carried there by wind and rain. This debris can plug up the entry to the downspout, and, as a result, force water to leak back into the facia area of the roof.

FIG. 1 (prior art) illustrates the problem with the conventional gutter system resulting from a plugged gutter.

What is needed therefore is a gutter system that can quickly and easily be moved away from the normal functional position to a protected position, so as to protect the gutter from ice build-up and/or tree debris.

BRIEF SUMMARY OF THE INVENTION

The invention is a retractable gutter system that includes a retractable support means that is mounted under the eaves of a structure and a gutter mounted on the retractable support means. In its gutter functional position, the retractable support means is pulled out, so that rainwater drains from the roof into the gutter. In regions that experience cold winters or in locations in which tree debris is copious at certain times of the year, it is desirable to avoid the build-up of ice and/or tree debris in the gutter. To that end, the retractable support means is constructed to be movable between a stowed position and its functional position, so that the gutter may be pushed in under the eaves in times of freezing temperatures or tree debris. On residential structures, the eaves overhang, i.e., the distance from the drip edge of the eaves to the outer surface of the wall, is typically 12 inches. The bottom face of this overhang is typically covered with a board, referred to as the soffit. The telescoping slides are not fastened to the fascia, but rather, are either mounted on cross brackets that are fastened to the soffit, or are fastened to the soffit directly.

During the spring and summer, the gutter is pulled out, so as to catch rainwater as it runs from the roof. In the fall, when leaves are coming down, and in the months when the temperature is frequently below freezing, the retractable support means may be pushed in to the stowed position, so that the gutter is under the eaves and, thus, protected from debris and ice.

The downspout on a gutter system includes a gutter downspout and a structure downspout. The gutter downspout is attached to the gutter and, in the conventional gutter system, is fitted into the top of the structure downspout from above. In the retractable gutter system according to the invention, the structure downspout has a cut-out at the top, on the wall that faces the structure. This allows the gutter downspout, when the gutter is pulled out to its functional position, to slide into the upper end of the structure downspout, so as to provide an enclosed conduit for the water to drain from the gutter into the spout.

The retractable gutter system according to the invention is adaptable to various types of structures. The gutters may be constructed of vinyl or metal gutter section, or be seamless metal lengths.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
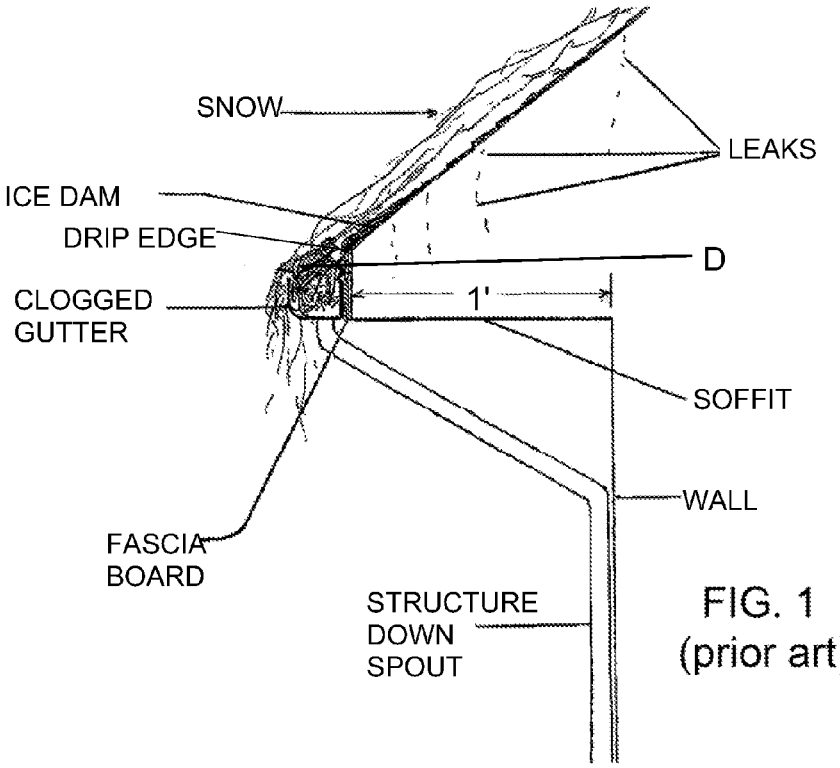
FIG. 1 (prior art)
FIG. 1 illustrates a conventional gutter system (prior art).

FIG. 1 illustrates a conventional gutter system. Snow is lying on the roof and the gutter is clogged with debris and/or ice. As a result, an ice dam has formed at the drip edge, which is forcing water back up under the roof shingles and into the interior of the structure.

Note: The reference designation D shown in the figures shall refer to debris, which term shall encompass leaves, ice, and any other matter that may clog a gutter.

Figure 2:
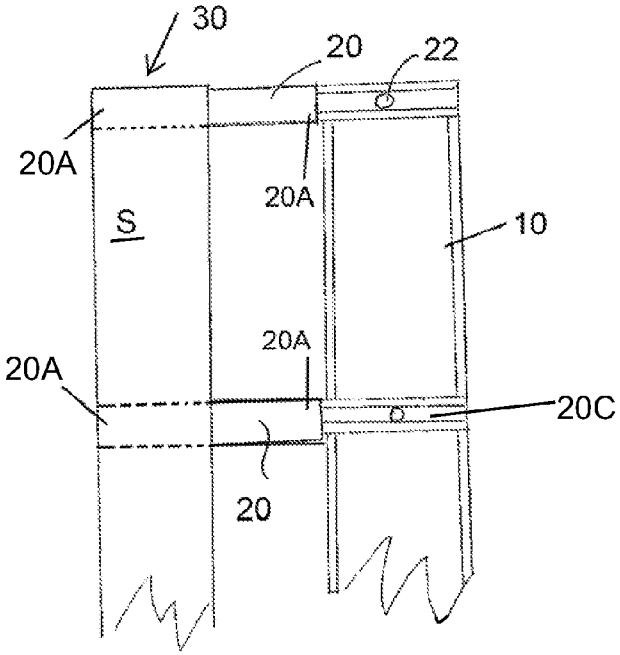
FIG. 2 illustrates the retractable gutter system according to the invention.
Figure 3:
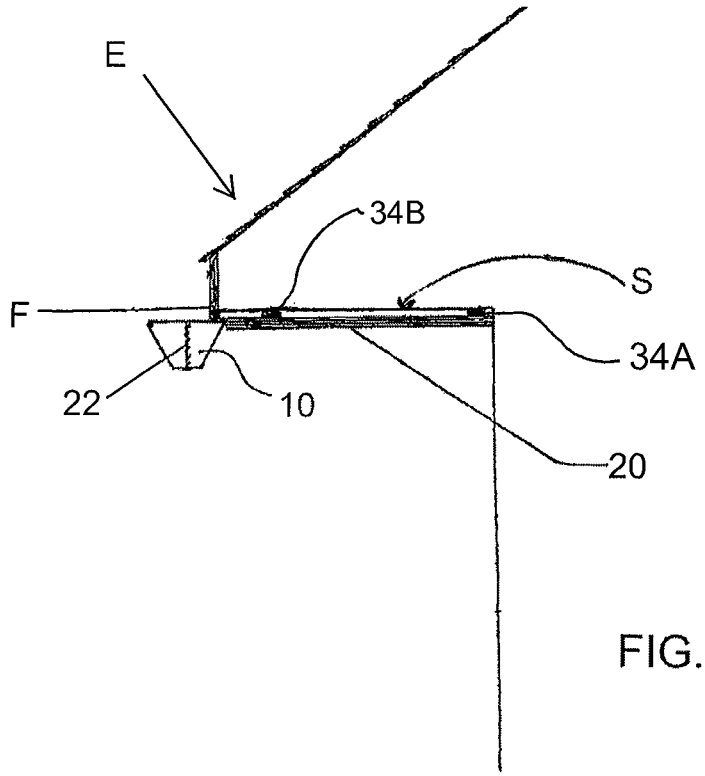
FIG. 3 illustrates the gutter of FIG. 2 mounted on the retractable slide and pulled out to the drip edge of the fascia.

FIG. 2 illustrates a retractable gutter system 100 according to the invention that is in its functional position. The figure is a top plan view of the system attached to a soffit S. For illustration purposes, roof shingles and fascia that are part of a roof system are not shown. The soffit S is the board that forms the underside of the eaves E, as shown in FIGS. 1 and 3. The retractable gutter system 100 comprises a gutter 10, at least two retractable slides 20, mounting means 30, and a downspout 40. Any conventional gutter may be used. The retractable slides 20 may be any type of telescoping slide or bracket that is suitable for this purpose. Drawer runner hardware is quite suitable, because the ball bearings in the runners ensure smooth motion. An example of suitable hardware are the Ball Bearing Side-Mount Drawer Slides Do-It-Yourself D806, made by Liberty Hardware Manufacturing Corp. Ideally, the retractable slide 20 is made of a metal or alloy that does not rust readily.

Figure 3A:
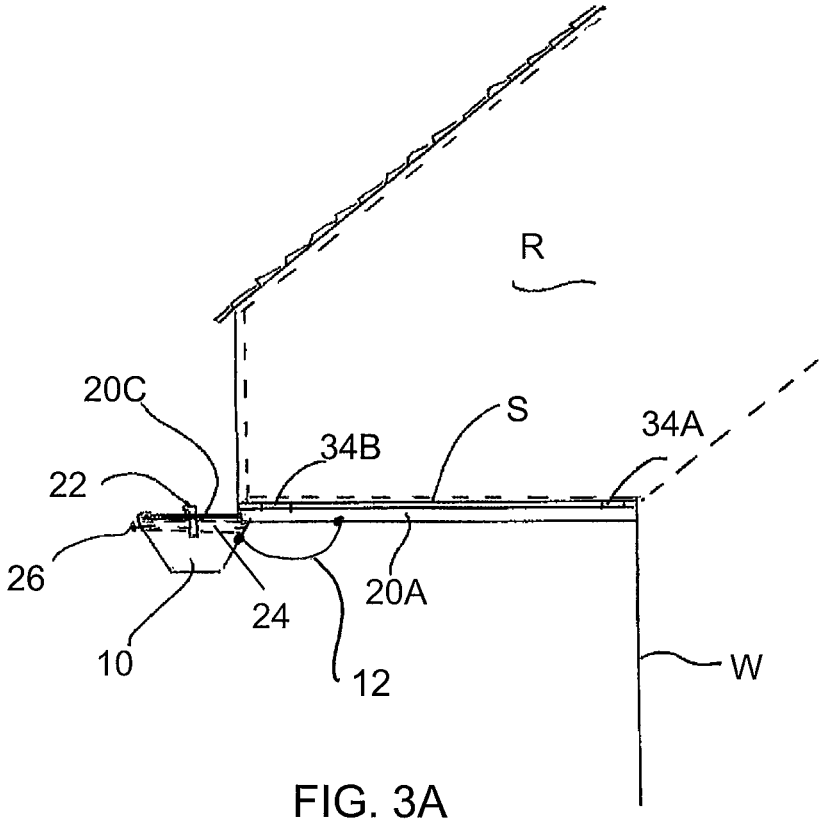
FIG. 3A illustrates a second means of mounting the gutter to the extension slide.

In the embodiment shown in FIG. 3, the gutter 10 is attached to the extension slide 20C of the retractable slide 20 by a gutter-fastening means 22, which, in this embodiment is a bolt that passes through a hole in the retractable slide 20 and through the bottom of the gutter 10 and is secured with a rubber washer and a nut. Other means of attaching the gutter 10 to the slide 20 are within the scope of the invention. For example, FIG. 3A illustrates a second embodiment, in which a brace 24 that is dimensioned to extend approximately the largest cross-sectional dimension transverse to axial direction of the gutter trough is attached to the underside of the extension slide 20C by means of the gutter fastening means 22, which is now a shortened bolt that passes through the slide 20 and the brace 24, but not through the bottom of the gutter 10. Fastening means 26 fasten the brace 24 to the front and rear walls of the gutter 10. The fastening means 26 may be screws, wing nuts, pins, or other suitable means. A particularly suitable material for the brace 24 is ultra high molecular weight polyethylene (UHMW PE), because it will not change dimensions to any significant extent as a function of temperature and humidity and is very rugged. Other suitable materials, however, may also be used.

FIGS. 2, 3, and 3A illustrate the mounting means 30. There are various suitable mounting means 30 and the following descriptions are not intended to be limiting. In the embodiment shown in these figures, the mounting means 30 includes at least two cross brackets 34 that extend the length of the eaves E that is to be fitted with the retractable gutter system 100. A front cross bracket 34A is affixed to the soffit S at a position closer to the structure and a rear cross bracket 34B affixed to the soffit closer to the fascia F. The cross brackets 34 may be provided as wooden or metal straps, but preferably, UHMW PE straps are used. In the embodiment shown, two cross brackets 34 are fastened through the soffit S to the rafters R. A rafter R is shown in dashed lines in FIG. 3A. The retractable slides 20 has a slide retainer 20A and an extension slide 20C captured in the slide retainer 20A, as shown in FIG. 2. The slide retainer 20A has a distal end that is mounted to the cross bracket 34A closer to the structure wall and a proximal end that is mounted to the cross bracket 34B closer to the fascia F. The retractable gutter system 100 is shown truncated, but it is understood that the gutter 10 extends the entire length of the eaves E and that a plurality of retractable slides 20 may used with the retractable gutter system 100, sufficient in number and evenly spaced apart to ensure a substantially even sliding motion of the entire length of gutter 10. An even sliding motion is particularly important if the gutter 10 along a single run is constructed in sections, as any "snaking" along the length of the gutter 10 may cause seams to open. For this reason, seamless gutters are preferred, as a long single gutter can withstand some snaking, without damaging the gutter.

Another example of the mounting means 30 includes the front cross-bracket 34B mounted to the soffit S closer to the fascia edge F of the eaves E. At each location where the retractable slide 20 is to be mounted, a transverse bracket that extends generally transverse to the axial direction of the front cross bracket 34B is affixed at a first end to the front cross bracket 34B and at a second end to the wall W. This mounting means 30 provides support for the retractable slide 20 from front to back and facilitates adjusting the position of the retractable slide 20 so that the gutter 10 is positioned directly under the drip edge of the eaves E. This particular mounting means 30 is not shown, but it is understood that a person of ordinary skill in the art will know how to place and secure the transverse brackets.

Figure 4:
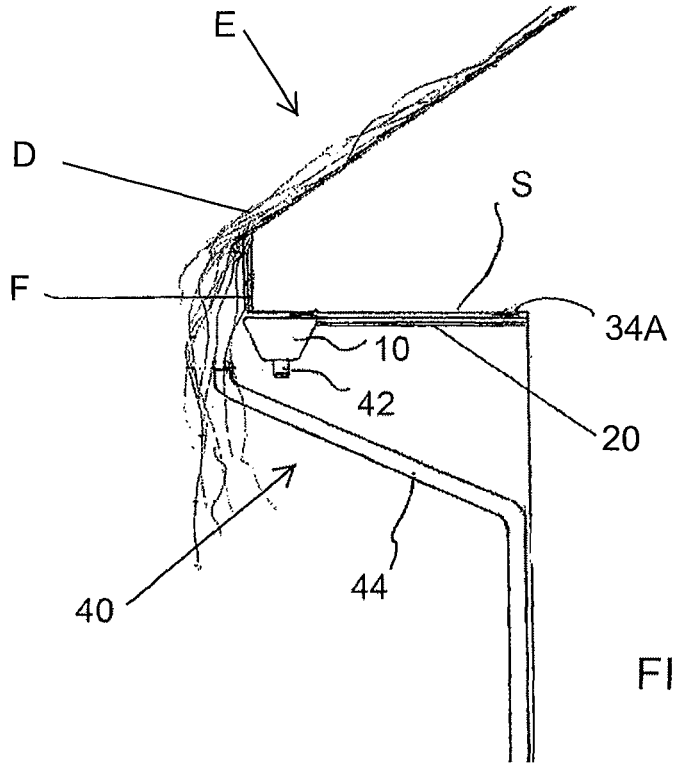
FIG. 4 illustrates the gutter of FIG. 2, mounted on the eaves of a structure and retracted.
Figure 6:
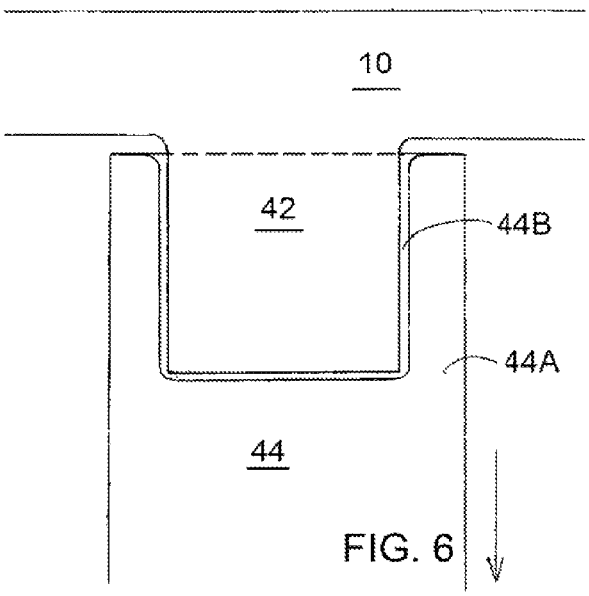
FIG. 6 illustrates how the gutter downspout fits into the structure downspout.
Figure 5:
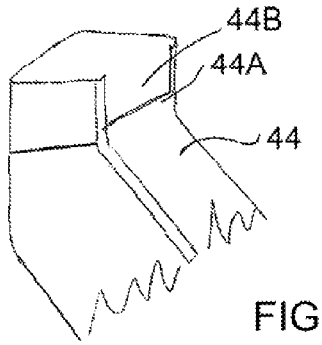
FIG. 5 shows a structure downspout with a cut-out.

FIG. 4 illustrates the retractable gutter system 100, retracted under the eaves E. FIGS. 4 and 5 illustrate details of the downspout 40, which includes a gutter downspout 42 and a structure downspout 44. A rear wall 44A in the structure downspout 44 has a cut-out 44B, that is dimensioned to receive the gutter downspout 42. FIG. 6 is a plan view of the downspout 40, viewed from the wall of the structure, showing how the gutter downspout 42 fits into the structure downspout 44 when the retractable gutter system 100 is extended out to its functional position.

Gutters are installed with a slope toward the downspout end of the gutter, to ensure proper drainage of water from the gutter. The retractable gutter system 100 according to the invention is mounted to the soffit S, which provides a horizontal plane, so the retractable gutter system requires some means to ensure the slope of the gutter. To maintain the desired slope, spacers or washers are used when mounting the retractable slides 20 to the soffit S. For example, assuming the retractable slides 20 are mounted to the soffit S spaced five feet apart, then a series of spacers with increasing thicknesses may be used to provide the desired slope. At the end opposite the downspout end, at the first retractable slide 20, no spacer is used, but then, at every mounting point toward the downspout end, a spacer with a slightly greater thickness is used, thereby achieving the desired slope of the gutter 10. The spacers may be provided with increasing thickness, or multiple spacers may be used to achieve the desired thickness. A suggested increment in thickness is ⅛-inch. Over a 40-foot span, spacers ranging from ⅛-inch to 1-inch may be used to achieve a ¼-inch drop per every ten feet of span. As with the cross brackets 34, the spacers may be stamped from UHMW PE. Metal washers or spacers made of other materials may also be suitable for this purpose.

Figure 7:
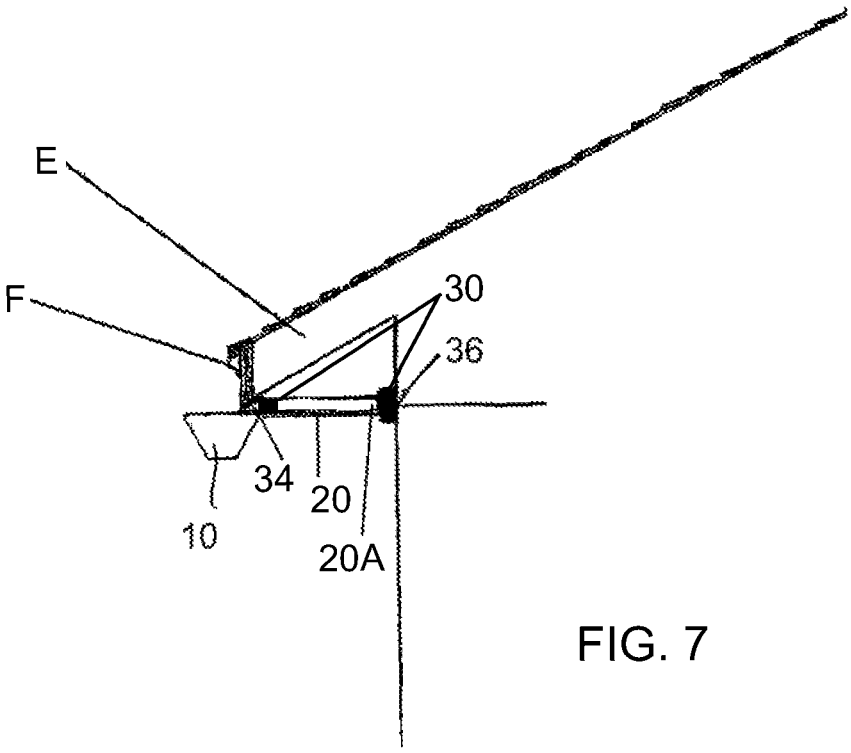
FIG. 7 illustrates the mounting means for an open-style eave.
Figure 7A:
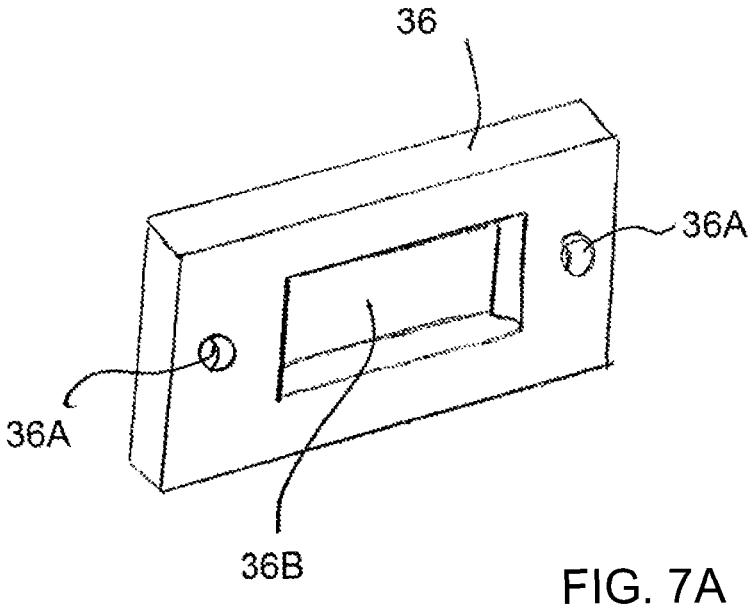
FIG. 7A shows a wall-mounting bracket.

FIG. 7 illustrates a suitable mounting means 30 for an eaves that does not have a soffit. A cross bracket 34 is attached close to the leading edge of the eaves and wall-mounting brackets 36 are fastened to the outer wall at spaced intervals. The distal end 20B of the slide 20 is supported by the wall-mounting bracket 36 and a proximal end 20A of the retractable slide 20, shown in FIG. 2, is then fastened to the cross bracket 34 and. The wall-mounting bracket 36 may be any suitable means to affix the distal end of 20B of the retractable slide 20 to the wall of the structure. FIG. 7A is an enlarged view of a simple bracket 36 that provides sufficient support to hold the retractable slide 20 firmly in place. The bracket 36 is, for example, stamped or machined from a piece of UHMW PE, having two through-bores 36A for mounting fasteners and a retainer bore 36B that is dimensioned to receive the distal end of the retractable slide 20. The distal end 20B is inserted into the retainer bore 36B and the proximal end 20A of the slide 20 then mounted to the cross bracket 34. Although the inventor has used UHMW PE for this bracket 36, because of the ability of the dense material to hold a threaded fastener, it is understood that other materials and other types of brackets may be used for the wall-mounting bracket 36.

Figure 8:
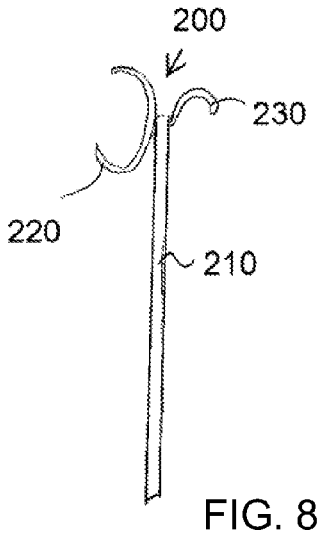
FIG. 8 illustrates a long-handled tool for manipulating the retractable gutter system.

FIG. 8 illustrates a device 200 for manipulating the retractable gutter system 100. The device 200 has a handle 210 and, at its upper end, a C-shaped bracket 220 for engaging the body of the gutter 10, when retracting the retractable gutter system and a hook 230 for engaging an upper edge of the gutter 10 when pulling the retractable gutter system to its functional position. The handle 210 may have extensions, to obtain the necessary height to engage the gutter 10 and move it between the protected and the functional positions.

The retractable gutter system 100 according to the invention will typically extend across a long expanse on a face of a structure, 20, 30, 40 feet or more. To ensure that the retractable gutter system 100 operates smoothly and easily, the retractable slides 20 are mounted on the cross brackets 34 at suitable distances apart, for example, every five feet or so. When a seamed gutter system is used, the inventor suggests strengthening the span of the gutter, to prevent cracks and, thus, leaks, from forming at the seams. One way to do this is to provide a reinforcing strip along the gutter 10, to ensure that the various segments of the gutter remain aligned when the gutter is being deployed or stowed away. For example, a one-inch strip of perforated steel may be affixed to the gutter 10, extending in the longitudinal direction of the gutter 10, to provide the desired stiffness. Another method is to reinforce the joints between gutters with fiberglass. This misalignment when extending/retracting the retractable gutter system is not a concern with seamless gutters, because there are no seams that will open up if the length of gutter span "snakes" a bit.

Figure 9:
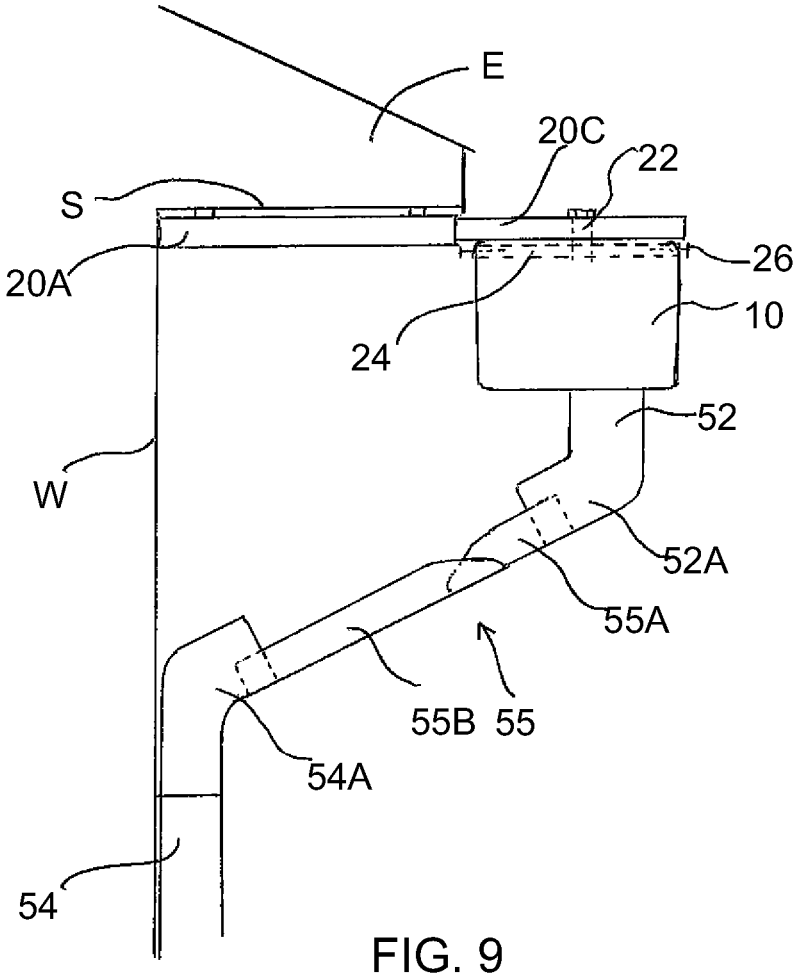
FIG. 9 illustrates a modified downspout.

FIG. 9 illustrates a modified downspout 50. It may be desirable to prevent snow, ice, debris from collecting in the upper part of the structure downspout 44 described above. The modified downspout 50 includes a structure downspout 54, a gutter downspout 52, and an extension trough 55. The structure downspout 54 has shortened upper end 54A that extends at an angle from the wall of the structure, whereby the end of the upper end 54A is still under the eaves E. The gutter downspout 52 has a lower end 52A that is angled toward the wall of the structure. The extension trough 55 is adjustable in length and connects the lower end 52A of the gutter downspout 52 to the upper end 54A of the structure downspout 54, to provide a continuous trough to guide water from the gutter 10 into the structure downspout 54. The extension trough 55 has a first rough section 55A that is affixed to the gutter downspout 52 and a second trough section affixed to the structure downspout 54. The first and second trough sections 55A and 55B are dimensioned such, that the free end of the first section is slidably held in the free end of the second section. When the gutter 10 is moved to the stowed position, the first section 55A slides into the second section 55B of the extension trough, so that the entire downspout system is now under the eaves E. When the gutter 10 is moved to its functional position, the extension trough 55 slidably accommodates the greater distance between the gutter 10 and the structure downspout 54. The lengths of the first and second trough sections 55A, 55B are variable and are dictated by the specific depth dimension of the eaves E.

As a safety measure, a tether means 12, shown in FIG. 3A, may be provided to securely connect the gutter to the structure. It is conceivable that a gutter filled with leaves, ice, or snow could become so heavy, that its weight exceeds the weight limit to be supported by the gutter fastening means 22 that connects the gutter 10 to the slides 20. The risk is such a situation is that the gutter 10 could inadvertently detach from the retractable slides 20. If that were to happen, the gutter 10 could drop away from the retractable gutter system, which could result in damage to the gutter, to the structure, and/or to something that the gutter drops onto. To reduce this risk, the tether means is constructed to prevent the gutter from dropping away into a free fall. The tether means includes a cable that is attached at one end to the structure and at the other end to the gutter. One or more of such cables may be attached to a length of gutter.

It is understood that the embodiments described herein are merely illustrative of the present invention. Variations in the construction of the retractable gutter system may be contemplated by one skilled in the art without limiting the intended scope of the invention herein disclosed and as defined by the following claims.

What is claimed is:

1. A retractable gutter system for a structure with a roof having eaves and a soffit, the retractable gutter system comprising:

a gutter for collecting water dripping from a drip edge of the eaves, the gutter extending in a direction parallel to the drip edge;

at least two retractable slides, each retractable slide being a telescoping slide that is configured to extend substantially along an entire length of the soffit and having a first section that is a slide track that is affixable to the soffit and a second section that is an extension slide, each extension slide having a first end that is slidably captured in the respective slide track and a second end that is slidable outward from the respective slide track away from the soffit;

a fastening means for fastening the gutter to each extension slide; and a downspout in the gutter for discharging water;

wherein the gutter is mounted on the second end of each extension slide; and wherein, when each extension slide is extended outward from the respective slide track, the gutter is positioned in a functional position at a drip edge of the eaves and when each extension slide is retracted into the respective slide track, the gutter is moved completely under the soffit into a stow position.

2. The retractable gutter system of claim 1, wherein the downspout comprises a gutter downspout incorporated into the gutter and a structure downspout that extends from the gutter downspout, and an extension trough that has first trough section that is affixed at one end to the gutter downspout and a second trough section that is affixed at one end to the structure downspout, wherein a free end of the first trough section is slidably held in the second trough section, so as to provide a continuous trough between the gutter downspout and the structure downspout that is adjustable in length, so as to accommodate movement of the gutter between the functional position and the stow position.

3. The retractable gutter system of claim 1, wherein an upper end of the structure downspout does not extend beyond an outer limit of the eaves.

4. The retractable gutter system of claim 1, wherein the structure downspout has an upper end that extends upward and beyond an outer limit of the eaves, the upper end having a downspout wall, one face of the downspout wall facing the structure, and wherein the one face has a cut-out dimensioned so as to receive the gutter downspout when the gutter is moved to its functional position.

5. The retractable gutter system of claim 1 further comprising a retractable-slide mounting means that includes a rear cross bracket that is affixed to the soffit at a position closer to the structure and a front cross bracket affixed to the soffit closer to the fascia and wherein at least one of the slide tracks is affixed to the rear cross bracket and the front cross bracket.

6. The retractable gutter system of claim 1, wherein the fastening means for fastening the gutter to each extension slide includes a brace that is affixed to an underside of each extension slide, the brace dimensioned to fit within the gutter in a direction transverse to the axial direction of the gutter, and further including a fastening device for securing ends of the brace to the gutter.

7. The retractable gutter system of claim 1, further comprising a device for selectively pushing and pulling the gutter between the functional position and the stow position, the device having handle and, at an upper end of the handle, a C-shaped bracket for engaging an outer wall contour of the gutter for pushing the gutter to the stow position and a hook for engaging an upper edge of the gutter for pulling the gutter to the functional position.

8. The retractable gutter system of claim 1, further comprising a safety tether device for preventing the gutter from free-falling away from one or more of the at least two retractable slides.

9. The retractable gutter system of claim 1, wherein the slide tracks and the extension slides are constructed of metal.

* * * * *